US005309720A

United States Patent [19]

Johnson et al.

[11] Patent Number: 5,309,720

[45] Date of Patent: May 10, 1994

[54] CRYOGENIC SYSTEM FOR PROCESSING A HYDROCARBON GAS STREAM

[75] Inventors: Lory L. Johnson, Oklahoma City, Okla.; Donald V. Nicol, Plano, Tex.

[73] Assignee: Q. B. Johnson Manufacturing, Inc., Oklahoma City, Okla.

[21] Appl. No.: 968,955

[22] Filed: Oct. 30, 1992

[51] Int. Cl.[5] ..... F25J 3/06

[52] U.S. Cl. ..... 62/23; 62/39

[58] Field of Search ..... 62/23, 39, 11, 9

[56] References Cited

U.S. PATENT DOCUMENTS

| | | | |
|---|---|---|---|
| 2,690,814 | 10/1954 | Reid | 183/114.6 |
| 2,728,406 | 12/1955 | Maher | 183/2.7 |
| 2,765,045 | 10/1956 | Meyers | 183/2.7 |
| 3,119,674 | 1/1964 | Glasgow et al. | 55/20 |
| 3,331,188 | 7/1967 | Sinex | 55/31 |
| 3,416,324 | 12/1968 | Swearingen | 62/39 |
| 3,433,026 | 3/1969 | Swearingen | 62/23 |
| 3,541,802 | 11/1970 | Swearingen | 62/23 |
| 3,735,600 | 5/1973 | Dowdell et al. | 62/9 |
| 4,579,565 | 4/1986 | Heath | 55/20 |

OTHER PUBLICATIONS

"Add piping to recover more NGL" by J. L. Wenger of Enogex Products Corp., Oklahoma City, Okla.; pp. 67-68; Aug., 1990.

*Primary Examiner*—Ronald C. Capossela

*Attorney, Agent, or Firm*—Bill D. McCarthy; Glen M. Burdick

[57] ABSTRACT

A cryogenic system for recovering a gas product stream and a liquid product stream from a hydrocarbon gas stream is provided which operates at process temperature of −50° F. or less. A portion of a refrigerating liquid stream and a cooled liquid stream produced during operation of the cryogenic system are passed heat exchange relationship with an inlet vapor stream and define a partially closed refrigeration loop. The partially closed refrigeration loop permits the low process temperatures to be achieved.

20 Claims, 2 Drawing Sheets

CRYOGENIC SYSTEM FOR PROCESSING A HYDROCARBON GAS STREAM

BACKGROUND OF THE INVENTION

1. Field of the Invention

The present invention relates to a system for processing a hydrocarbon gas stream, and more particularly but not by way of limitation, to a cryogenic system for recovering a gas product stream and a liquid product stream from a hydrocarbon gas stream.

2. Brief Description of the Prior Art

Hydrocarbon gas streams produced from subterranean formations often contain fuel gas, liquid hydrocarbons and connate or formation waters. To enhance the heating value of the fuel gas, it is desirable that the fuel gas be separated from the liquid hydrocarbons and formation waters. Further, it is desirable that the liquid hydrocarbons be recovered.

Numerous systems have heretofore been proposed for separating fuel gas and liquid hydrocarbons from a hydrocarbon gas stream. However, the processing conditions of such prior art systems are generally limited, for economic reasons, to process temperatures which comprise separation of the fuel gas and the liquid hydrocarbons. That is, most of the prior art systems are limited to a process temperature of no lower than about −40° F., which often results in ineffective separation of a fuel gas having a high BTU value from the liquid hydrocarbons. Thus, new and improved methods for separating fuel gas and liquid hydrocarbons from a hydrocarbon gas stream so as to provide a fuel gas product stream having an improved heating value and a hydrocarbon product stream are constantly being sought. It is to such a system that the present invention is directed.

SUMMARY OF THE INVENTION

According to the present invention a cryogenic system for recovering a gas product stream and a liquid product stream from a hydrocarbon gas stream is provided in which the gas product stream has an enhanced heating value. Broadly, the system comprises separating the hydrocarbon gas stream into a first liquid stream and an inlet vapor stream.

The inlet vapor stream is cooled in a heat exchange means to a processing temperature of at least below about −50° F. The cooled effluent vapor stream is then passed to a cold separator vessel wherein it is separated to a first non-condensible vapor stream and a second liquid stream. The second liquid hydrocarbon stream is passed from the cold separator vessel to a cold flash vessel; and the first non-condensible vapor stream is passed from the cold separator vessel through the heat exchanger means in a heat exchange relationship with a first portion of the inlet vapor stream. The non-condensible vapor stream is thereafter recovered as a first portion of the gas product stream.

The second liquid hydrocarbon stream is separated in the cold flash vessel into an outlet vapor stream and a refrigerating liquid stream. The outlet vapor stream is passed through the heat exchanger means in a heat exchange relationship with a second portion of the inlet vapor stream, compressed to a predetermined pressure and recovered as a second portion of the gas product stream.

A portion of the refrigerating fluid stream is expanded so as to reduce the pressure of the refrigerating fluid stream to less than about 25 psig and a temperature of less than about −70° F. The expanded refrigerating fluid stream is then passed through the heat exchanger means in a heat exchange relationship with a third portion of the inlet vapor stream and thereafter compressed and separated into a compressed vapor stream, a fluid stream and a third liquid stream. The third liquid stream is expanded to produce a cooled third liquid stream. The cooled third liquid is then passed through the heat exchanger means wherein it is contacted with the expanded refrigerating fluid stream and in a heat exchange relationship with the third portion of the inlet vapor stream. The first liquid stream and the fluid stream are introduced into a stabilizer vessel. Stabilization and mass transfer of the first liquid stream and the fluid stream produces a second non-condensible vapor stream and is recovered as a third portion of the gas product stream. Thus, the first non-condensible vapor stream, the outlet vapor stream and the second non-condensible vapor stream constitute and are recovered as the gas product stream.

An object of the present invention is to provide a new and effective system for separating a fuel gas product stream and a liquid hydrocarbon stream from a hydrocarbon gas stream.

Another object of the present invention, while achieving the before stated object, is to provide an improved cryogenic system for separating a fuel gas product stream and a liquid hydrocarbon stream from a hydrocarbon gas stream having improved refrigeration capacity.

Yet another object of the present invention, while achieving the before-stated objects, is to provide an improved cryogenic system for separating a fuel gas product stream and a liquid hydrocarbon product stream from a hydrocarbon gas stream which is readily controllable and enhances improved separation of the gas fuel product stream and the liquid hydrocarbon product stream of a hydrocarbon gas stream.

Other objects, advantages and features of the present invention will become apparent to those skilled in the art from a reading of the following description when read in conjunction with the drawings.

DETAILED DESCRIPTION

Figure 1A:
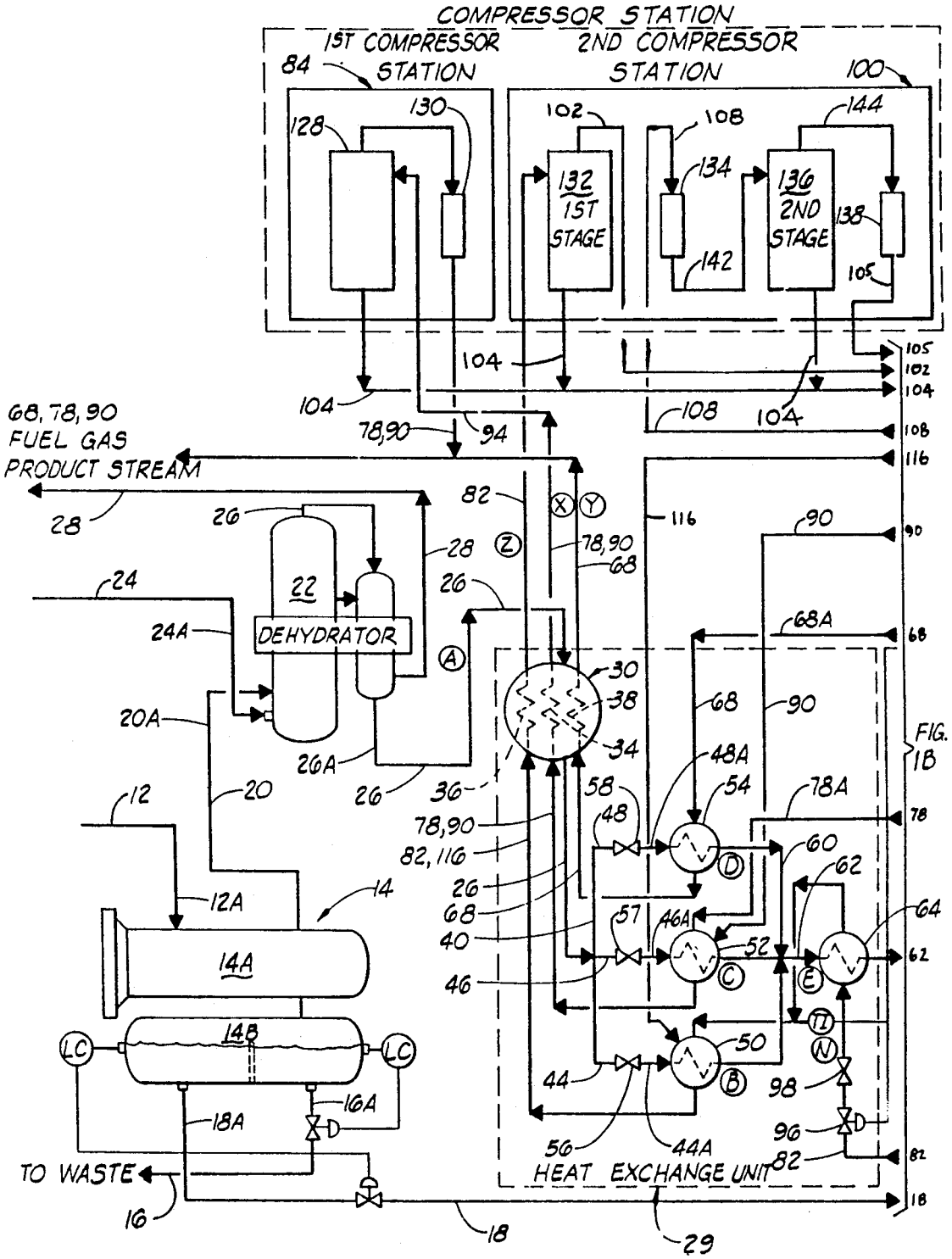
FIG. 1A is a first section of a schematic diagram of an improved cryogenic system for separating a fuel gas product stream and a liquid hydrocarbon product stream from a hydrocarbon gas stream in accordance with the present invention.
Figure 1B:
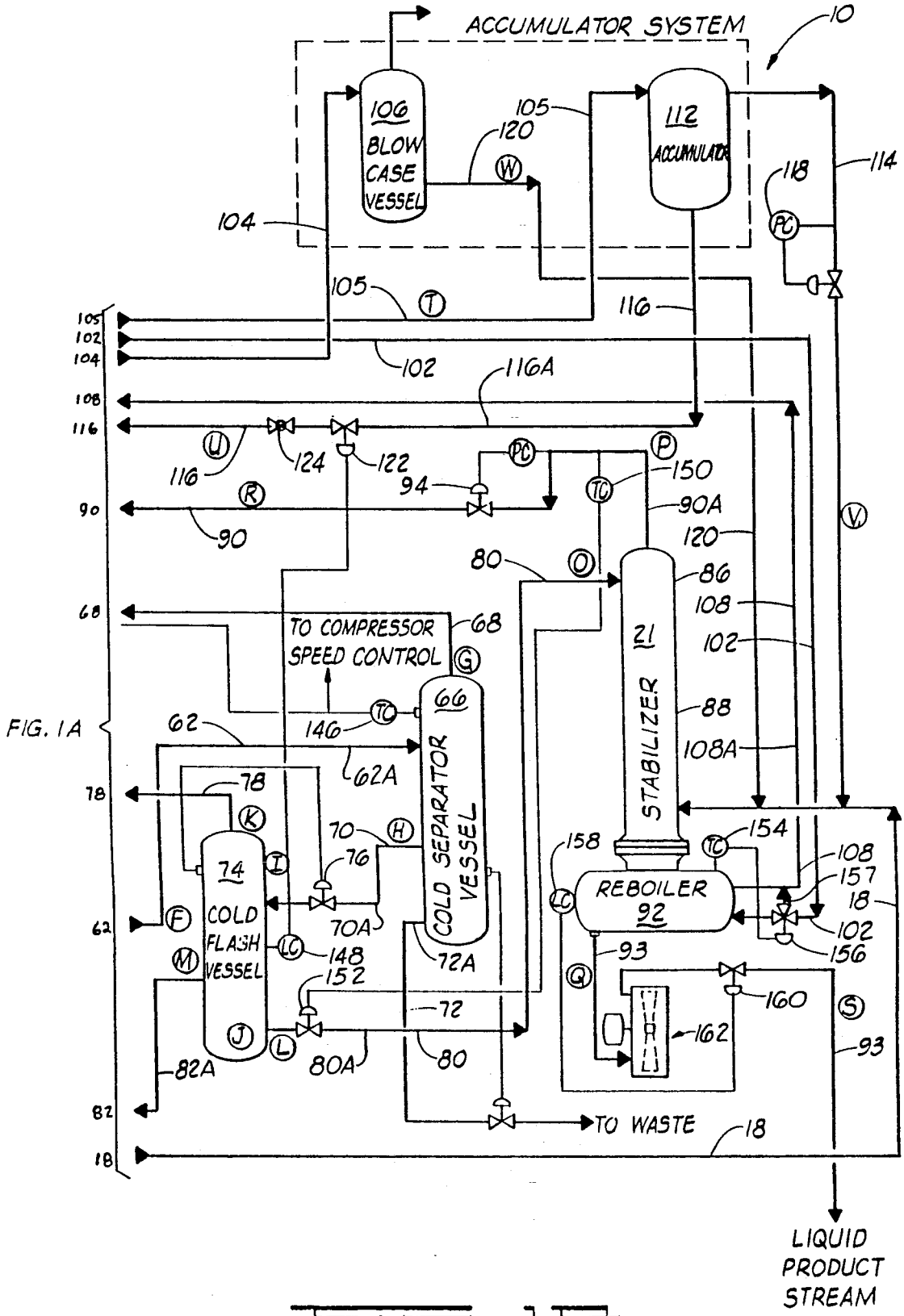
FIG. 1B is a second section of the schematic diagram of the cryogenic system of the present invention.

Referring now to the drawing, a hydrocarbon gas stream, such as a natural gas stream, is processed in a cryogenic gas processing system 10 of the present invention. It should be understood that certain valves and controls of the cryogenic gas processing system 10 have been eliminated for the purpose of clarity, and inclusion of such valves and controls herein is not believed necessary for one to understand the cryogenic gas processing system 10 of the present invention, and its operation.

An inlet hydrocarbon gas stream 12 processed in the cryogenic gas processing system 10 can be produced from one or more subterranean formations, and is introduced into the cryogenic gas processing system 10 via a conduit 12A. Thus, the inlet hydrocarbon gas stream 12 will generally have a pressure and temperature substantially corresponding to the temperature and pressure of the formation; and the inlet hydrocarbon gas stream 12 will generally contain fuel gas, liquid hydrocarbons and connate or formation water. Typically, the inlet hydrocarbon gas stream 12 will have a pressure of from about 400 to about 1000 psig and a temperature of from about 70° F. to about 120° F.

The inlet hydrocarbon gas stream 12 entering the cryogenic gas processing system 10 passes into a three-phase separator unit 14 where the inlet hydrocarbon gas stream 12 is separated into a first waste stream 16, a first liquid stream 18 and an inlet vapor stream 20. The first waste stream 16, which contains free water, is collected in a separator vessel 14B and level controlled to waste through a conduit 16A. The first liquid stream 18 is also collected in the separator vessel 14B and level controlled to a stabilizer vessel 21 via conduit 18A.

The inlet vapor stream 20 separated from the first waste stream 16 and the first liquid hydrocarbon stream 18 is passed from a separator vessel 14A for dehydration to a glycol gas contactor or absorber unit 22 via conduit 20A. A glycol stream 24 is injected into the absorber unit 22 via conduit 24A. Dehydration of the inlet vapor stream 20 by contact with the glycol stream 24 produces a dehydrated inlet vapor stream 26 having a low water dew point and a spent glycol stream 28. The spent glycol stream 28 is withdrawn from the absorber unit 22 and passed to a glycol regeneration unit (not shown) via conduit 28A; and the dehydrated inlet vapor stream 26 is passed from the absorber unit 22 through a heat exchanger unit 29.

While dehydration employed in the cryogenic gas processing system 10 has been shown as being accomplished by a glycol gas contactor or absorber unit 22, it should be understood that any suitable dehydration unit can be employed to dehydrate the inlet vapor stream 20. The selection of the dehydration unit will be dependent, to a large degree, on the composition of the inlet hydrocarbon gas stream 12, as well as the composition of the recovered gas product stream and the liquid product stream described further below. Thus, the dehydrating unit can be a molecular sieve unit or any other type of dehydration unit capable of removing substantially all of the entrained water vapors from the inlet vapor stream 20 to provide the dehydrated inlet vapor stream 26 with a low water dew point.

As previously stated, the dehydrated inlet vapor stream 26 is passed from the absorber unit 22 to the heat exchange unit 29. That is, the dehydrated inlet vapor stream 26 is passed from the absorber unit 22 to the shell side of the multi-channel heat exchanger 30 via conduit 26A. The multi-channel heat exchanger 30 is provided with a central channel 34 and outer channels 36, 38. Thus, the dehydrated inlet vapor stream 26 passes through the shell side of the multi-channel heat exchanger 30 in indirect heat exchange with fluids flowing through the central channel 34 and the outer channels 36, 38. Desirably, an external layer of heat insulating material (not shown) can be applied to the outer periphery of the multi-channel heat exchanger 30.

The cooled, dehydrated inlet vapor stream 26 is passed through the multi-channel heat exchanger 30 and into a first manifold 40. The cooled, dehydrated inlet vapor stream 26 is divided into three separate streams 44, 46 and 48 by the first manifold 40 and these three streams 44, 46 and 48 are passed via conduits 44A, 46A and 48A through heat exchangers 50, 52 and 54, respectively. To regulate the flow of the cooled dehydrated inlet streams 44, 46 and 48 through the heat exchangers 50, 52, and 54, adjustment valves 56, 57 and 58 are disposed in conduits 44A, 46A and 48A, respectively.

After passage through the heat exchangers 50, 52 and 54, the three cooled, dehydrated inlet vapor streams 44, 46 and 48 are passed to a second manifold 60, where the three inlet vapor streams 44, 46 and 48 are recombined and passed as a cooled dehydrated vapor stream 62 through a chiller 64.

Cooling of the dehydrated inlet vapor stream 62 to a processing temperature of about −50° F. or less in the chiller 64 results in a multi-phase stream. The multi-phase cooled dehydrated vapor stream 62 is passed from the chiller 64 to a cold separator vessel 66 via conduit 62A. The cooled dehydrated vapor stream 62 is separated in the cold separator vessel 66 into a first non-condensible vapor stream 68, a second liquid stream 70 and a second waste stream 72. The second waste stream 72 is collected in the cold separator vessel 66 and level controlled to waste via conduit 72A; and the second liquid stream 70 is collected in the cold separator vessel 66 and passed to a cold flash vessel 74 via conduit 70A. Passage of the second liquid stream 70 from the cold separator vessel 66 to the cold flash vessel 74 can be controlled by employing a pressure control valve 76 or other suitable control valve, such as a level control valve or a pressure/level control valve.

The first non-condensible overhead vapor stream 68, separated from the second liquid stream 70 and the second waste stream 72, is passed from the cold separator vessel 66 via conduit 68A through the shell side of the heat exchanger 54 and the outer channel 38 of the multi-channel heat exchanger 30. After passage through the outer channel 38 of the multi-channel heat exchanger 30, the first non-condensible overhead vapor stream 68 (which constitutes a portion of the gas product stream to be recovered) is passed to a fuel gas product gathering system (not shown).

The second liquid stream 70 is separated in the cold flash vessel 74 into an overhead vapor stream 78, a first refrigerating liquid stream 80 and a second refrigerating liquid stream 82. The overhead vapor stream 78 is passed via conduit 78A through the shell side of the heat exchanger 52 and the central channel 34 of the multi-channel heat exchanger 30. After passage through the central channel 34 of the multi-channel heat exchanger 30, the overhead vapor stream 78 is passed to a first compressor station 84 to be compressed up to sales line pressure prior to being combined with the first non-condensible overhead vapor stream 68 to form the fuel gas product stream. It should be noted that if the fuel gas product stream produced by the cryogenic gas processing system 10 is a low pressure stream, compression of the overhead vapor stream 78 is not required. Thus, when the produced fuel gas product stream is a low pressure stream, the overhead vapor stream 78 can be combined directly with the first non-condensible overhead vapor stream 68 for passage to the fuel gas product gathering system (not shown).

The first refrigerating liquid stream 80 separated from the overhead vapor stream 78 and the second refrigerating liquid stream 82 in the cold flash vessel 74 is level controlled from the cold flash vessel 74 to a condenser section 86 of the stabilizer vessel 21 via conduit 80A. Two-phase flow from the condenser section 86 through a trayed or packed section 88 of the stabilizer vessel 21 provides mass transfer and stabilization of fluids in the stabilizer vessel 21. That is, mass transfer and stabilization of the fluids in the stabilizer vessel 21 result in an overhead stabilizer vapor stream 90 passing upwardly and out of the stabilizer vessel 21 and the heavier ends of the fluids being stripped, passing downwardly into a reboiler 92 for subsequent recovery as a liquid product stream 93.

The overhead stabilizer vapor stream 90 passes out of the stabilizer vessel 21 via conduit 90A through a pressure control valve 94 so that stabilization pressure is maintained in the stabilizer vessel 21. The overhead stabilizer vapor stream 90 is then directed to the shell side of heat exchanger 52 wherein it combines with the overhead vapor stream 78 from the cold flash vessel 74. From the heat exchanger 52 the combined stream constituting the overhead vapor stream 78 and the overhead stabilizer vapor stream 90 is passed through the central channel 34 of the multi-channel heat exchanger 30 and to the first compressor station 84 where the combined stream is compressed to sales gas line pressure for delivery to the fuel gas product gathering system (not shown).

The second refrigerating fluid stream 82 separated from the overhead vapor stream 78 and the first refrigerating fluid stream 80 in the cold flash vessel 74 is level controlled from the cold flash vessel 74 via conduit 82A to the shell side of the chiller 64 through a level control valve 96 and an expansion valve 98. Passage of the second refrigerating fluid stream 82 through the expansion valve 98 provides an ensuing pressure and temperature drop of the second refrigerating fluid stream 82. For example, if one were operating at a processing temperature of −50° F. in the cold separator vessel 66, and the second liquid stream 70 passed to the cold flash vessel 74 from the cold separator vessel 66 was at a pressure of about 400 psig, the pressure drop of the second refrigerating fluid stream 82 through the expansion valve 98 would lower the temperature of the second refrigerating fluid stream 82 from about −70° F. to about −128° F. As a result, the process temperature in the cold flash vessel 74 would be approximately −65° F. to −70° F.

Because of the temperature of the second refrigerating liquid stream 82, the second refrigerating liquid stream 82 will commence boiling in the chiller 64. Boiling of the second refrigerating stream 82 produces a multi-phase stream, i.e. a stream having a vapor phase and a liquid phase. The multi-phase second refrigerating liquid stream 82 is passed from the chiller 64 through the shell side of heat exchanger 50 and the outer channel 36 of the multi-channel heat exchanger 30. After passage through the outer channel 36 of the multi-channel heat exchanger 30, the second refrigerating liquid stream 82 is passed to a second compressor station 100. Thus, the second refrigerating liquid stream 82 achieves cooling and partial condensation of the dehydrated vapor stream 62 during passage of the dehydrated vapor stream 62 through the chiller 64.

Compression of the second refrigerating liquid stream 82 by the compressor station 100 results in a compressed vapor stream 102, a first fluid stream 104 and a third liquid stream 105. The first fluid stream 104 is level controlled to a blow case vessel 106; and the compressed vapor stream 102 (which has a temperature of from about 200° F. to 250° F.) is passed from the compressor station 100 to coils or an exchanger bundle (not shown) in the reboiler 92. Thus, the compressed vapor stream 102 provides heat for reboiling and stabilization of the fluids in the stabilizer vessel 21. After passage through the exchanger bundle (not shown) in the reboiler 92 a cooled compressed vapor stream 108 is passed to an air cooler 134 on an external compression skid of the compressor station 100 and recompressed.

The third liquid stream 105 (which has been cooled to a 20° approach to ambient temperature and has a pressure of about 600 psig) is passed from the external compression skid of the compressor station 100 into an accumulator vessel 112. The third liquid stream 105 is a two-phase stream having a liquid-vapor phase and a liquid phase. The liquid-vapor phase and the liquid phase of the third liquid stream 105 are separated in the accumulator vessel 112 to provide a liquid-vapor stream 114 and a second fluid stream 116. The liquid-vapor stream 114 is passed from the accumulator vessel 112, through an expansion valve 118, and combined with the first liquid stream 18 for introduction into the stabilizer vessel 21. Passage of the liquid-vapor stream 114 through the expansion valve 118 reduces the pressure of the liquid-vapor stream 114 to the pressure of the stabilizer vessel 21, a pressure less than the pressure of the cold separator vessel 66 and the cold flash vessel 74.

The first fluid stream 104, which is made up of liquids removed during recompression of the compressed vapor stream 102 in the second compressor station 100 and/or during compression of the combined overhead vapor stream 78 and the overhead stabilizer vapor stream 90 up to sales line pressure in the first compressor station 84 is, as previously stated, level controlled to the blow case vessel 106 which functions as a pneumatic pump-accumulator. Thus, when sufficient liquids are accumulated in the blow case vessel 106, a blow case liquid stream 120 is pumped from the blow case vessel 106 to the stabilizer vessel 21 where the blow case liquid stream 120 is combined with the first liquid stream 18, the liquid-vapor stream 114 and the first liquid refrigerating stream 80.

The cooled second fluid stream 116 is level controlled from the accumulator vessel 112 via conduit 116A and a level control valve 122, through an expansion valve 124 and into the shell side of heat exchanger 50. Because the fluids are maintained under pressure (i.e. about 600 psig) in the accumulator vessel 112, a substantial temperature drop of the second fluid stream 116 (such as from about 120° F. to about 0° F.) occurs between the upstream side of the expansion valve 124 and the downstream side of the expansion valve 124. Thus, when the second fluid stream 116 enters the shell side of the heat exchanger 50 and is combined with the second refrigerating fluid stream 82 from the cold flash vessel 74, a combined stream of the second refrigerating fluid stream 82 and the second fluid stream 116 is formed which produces a partially closed refrigeration loop for the cryogenic gas processing system 10. The partially closed refrigeration loop provides an effective method for enhancing the refrigeration capacity of the cryogenic gas processing system 10 without additional cooling of the second fluid stream 116.

The first compressor station 84 is a conventional single stage compressor having a scrubber vessel 128 and a compressor/cooler module 130. The overhead stabilizer vapor stream 90 and the cold flash vessel overhead vapor stream 78 (which are combined in the heat exchanger 52 prior to passage through the central channel 34 of the multi-channel heat exchanger 30) are introduced into the scrubber vessel 128. Any entrained liquid hydrocarbons separated from the combined overhead vapor stream 78 and the overhead stabilizer vapor stream 90 are collected in the scrubber vessel 128 and level controlled to the blow case vessel 106. The vapor phase of the combined overhead vapor stream 78 and the overhead stabilizer vapor stream 90, which constitutes a portion of the gas product stream recovered, is passed from the scrubber vessel 128 to the compressor/-cooler module 130 wherein the combined vapor streams are compressed to a sales gas line pressure and cooled. The compressed, cooled vapor stream (i.e. the overhead vapor stream 78 and the overhead stabilizer vapor stream 90) is then passed from the compressor/cooler module 130 as a portion of the fuel gas product stream.

The second compressor station 100 is illustrated as having two stages of compression. Thus, the second compressor station 100 has a first scrubber/compression module 132, a first cooler module 134, a second scrubber/compression module 136 and a second cooler module 138. As previously stated, the second refrigerating fluid stream 82 and the cooled second fluid stream 116 are combined in the heat exchanger 50. The combined second refrigerating fluid stream 82 and the cooled second fluid stream 116 are passed from the heat exchanger 50, through the outer channel 36 of the multi-channel heat exchanger 30, and into the first scrubber/-compression module 132 of the second compressor station 100. Any liquids present in the combined second refrigerating fluid stream 82 and the cooled second fluid stream 116 are separated and collected in the first scrubber/compression module 132. The collected liquids are level controlled to the blow case vessel 106 as a portion of the compressed first fluid stream 104.

A compressed vapor stream 144 is passed from the second scrubber/compression moduel 136 to the cooler module 138 so as to form the third liquid stream 105 which is passed to the accumulator vessel 112 as heretofore described.

The compressed vapor stream 102, which is a heated vapor stream having a temperature of from about 200° F. to about 250° F. exits a first stage cylinder of the first scrubber/compression module 132 and is passed to the coils or exchanger bundle (not shown) in the reboiler 92. Thus, the compressed vapor stream 102 from the first stage cylinder of the first scrubber/compression module 132 provides the heat for the reboiler 92. After passage through the coils or exchange bundle in the reboiler 92, the cooled, compressed vapor stream 108 is passed to an air cooler 134.

The third liquid stream 105 flowing from an air cooler 138 of the second scrubber/compression module 136 is a two-phase stream having an approximately 20° approach to ambient temperature. The third liquid stream 105 is passed from the air cooler of the second scrubber/compression module 136 to the accumulator vessel 112 as heretofore described.

As previously stated, the liquids collected in the accumulator vessel 112 are maintained at a predetermined pressure. Thus, when the liquids are passed from the accumulator vessel 112 as the second fluid stream 116 and passed through the expansion valve 124, an ensuing pressure drop occurs so that the pressure of the second fluid stream 116 in the resulting cooled second fluid stream 116 is approximately equal to the suction pressure of the second compressor station 100 and a substantial temperature drop occurs across the expansion valve 124. For example, if the fluids in the accumulator vessel 112 are pressurized to 600 psig and the pressure of the second fluid stream 116 is reduced to approximately 25 psig by passage through the expansion valve 124, the temperature of the second fluid stream 116 on the upside of the expansion valve 124 would be approximately 100° F., whereas the temperature of the second fluid stream 116 on the downstream side of the expansion valve 124 would be about 0° F.

In order to provide effective control of the cryogenic gas processing system 10, a temperature controller 146 is connected to the cold separator vessel 66. The temperature controller 146, which detects the temperature in the cold separator vessel 66 is operably connected to the second compressor station 100 so that the speed and throughput of the second compressor station 100 are in response to signals provided the second compressor station 100 by the temperature controller 146. The temperature controller 146 is also operably connected to the level control valve 96. Thus, the temperature controller 146 permits a metered amount of the second refrigerating fluid stream 82 to pass from the cold flash vessel 74 to the chiller 64, and thus to heat exchanger 50, the multi-channel heat exchanger 30 and the first stage suction scrubber of the second compressor station 100.

The flow rate of the second liquid stream 70 from the cold separator vessel 66 into the cold flash vessel 74 is controlled in response to the pressure in the cold flash vessel 74. Thus, if the pressure in the cold flash vessel 74 goes down, the pressure control valve 76 will open and permit the second liquid stream 70 to pass from the cold separator vessel 66 to the cold flash vessel 74 which results in additional vapors and liquid/vapors being introduced into the cold separator vessel 66.

The level of the second refrigerating fluid stream 82 in the cold flash vessel 74 is controlled via a level controller 148. Thus, the amount of the second refrigerating fluid stream 82 passed to the second compressor station 100 will be dependent upon the level of the liquids in the cold flash vessel 74. That is, if the level controller 148 detects an inadequate level of liquids in the cold flash vessel 74, the level control valve 122 will open and provide additional refrigeration through the heat exchanger 50 by permitting passage of the cooled second fluid stream 116 from the accumulator vessel 112 to the shell side of heat exchanger 50, thereby reducing the amount of the second refrigerating fluid stream 82 passing from the cold flash vessel 74 across the expansion valve 98 and into the chiller 64.

When it is determined that there is a sufficient level of the second refrigerating fluid stream 82 in cold flash vessel 74, a low level switch provides a signal to a temperature controller 150 on the overhead vapors of the stabilizer vessel 21. That is, the switch indicates that there is an adequate level of the second refrigerating fluid stream 82 in the cold flash vessel 74 so that the feed rate of the first refrigerating fluid stream 80 from the cold flash vessel 74 into the stabilizer vessel 21 can be controlled by the temperature controller 150. When it is determined that the temperature in the stabilizer vessel 21 exceeds the set point of the temperature controller 150, a signal is sent to open a control valve 152 so that the first refrigerating fluid stream 80 will be passed into the condenser section 86 of the stabilizer vessel 21. On the other hand, if the temperature in the stabilizer vessel 21 is below the set point of the temperature controller 150, the temperature controller 150 interrupts the signal and causes the control valve 152 to pinch off or slow the flow of the first refrigerating fluid stream 80 from the cold flash vessel 74 to the stabilizer vessel 21.

The reboiler 92 is also provided with a temperature controller 154 operably connected to a control valve 156. The control valve 156 is a three-way valve which permits the compressed vapor stream 102 from the second compressor station 100 to bypass the reboiler 92. That is, when the temperature in the reboiler 92 exceeds a predetermined set point, the compressed vapor stream 102 from the second compressor station 100 is combined with the cooled, compressed vapor stream 108 via conduit 157 and the resulting stream is directed into conduit 108A so that the compressed vapor stream 102 bypasses the reboiler 92. In addition, the reboiler 92 is provided with a level controller 158 and a level control valve 160 so that the liquid product stream 93 produced in the reboiler 92 can be discharged through a product cooler 162 to a storage tank (not shown).

It should be noted that the cryogenic gas processing system 10 of the present invention is adaptable for deep ethane recovery. When utilizing the cryogenic gas processing system 10 for deep ethane recovery, a different type of dehydration unit should be selected, rather than the glycol gas contactor unit previously discussed. That is, one would in most instances select a molecular sieve dehydration unit due to the requirement for providing operating temperatures of from about −80° F. to about −150° F. in the cold separator vessel 66. In addition, one would be required to provide a colder condenser section 86 in the top of the stabilizer vessel 21. Such could be accomplished by taking heat out of the liquid-vapor stream 114 passing from the accumulator vessel 112 to the stabilizer vessel 21. Further, one could provide additional stages of compression in the second compressor station 100. That is, the second compressor station 100 selected may desirably have three or even four stages of compression. By utilizing additional stages of compression one could raise the pressure to 1000 or 1200 pounds in the accumulator vessel 112 and then expand the liquid-vapor stream 114 through an expansion valve into the stabilizer vessel 21; and if required, utilize multiple feeds of the liquid-vapor stream 114 into the stabilizer vessel 21. Any particular design characteristics of the system can be readily determined and will depend to a large degree upon the operating parameters required. Thus, it is envisioned that other modifications could be made to cryogenic gas processing system 10 of the present invention to further enhance deep ethane recovery. However, it is believed that such modifications are well within the scope of the invention as described herein.

In order to further illustrate the present invention, the following example is given. However, it is to be understood that the example is for illustrative purposes only and is not to be construed as limiting the scope of the present invention as recited in the claims appended hereto.

EXAMPLE

Recovery of a gas product stream and a liquid product stream utilizing the cryogenic gas processing system 10 of the present invention was simulated using Hyprotech's Process Simulator HVSIM. The following Table indicates a material/energy balance and process conditions at the various locations indicated by the column designations (and as these column designations appear in the drawings of the cryogenic gas processing system 10. The data set forth clearly indicates improved separation of a gas product stream and a liquid product stream from a hydrocarbon gas stream employing the cryogenic gas processing system 10 of the present invention.

TABLE

| | Stream | | | | | |
|---|---|---|---|---|---|---|
| | A | B | C | D | E | F |
| Vapour frac. | 1.0000 | 0.7818 | 0.7290 | 0.7631 | 0.7547 | 0.5657 |
| Temperature F. | 100.0000 | −6.9086 | −20.0090 | −11.7741 | −13.8761 | −50.0688 |
| Pressure psia | 815.0000 | 812.0000 | 812.0000 | 812.0000 | 812.0000 | 808.0000 |
| Molar Flow 1 bmole/hr | 878.4376 | 175.6875 | 325.0219 | 377.7281 | 878.4376 | 878.4376 |
| Mass Flow lb/hr | 19713.5504 | 3942.7099 | 7294.0138 | 8476.8264 | 19713.5504 | 19713.5504 |
| Liq Vol Flow barrel/day | 3713.2653 | 742.6530 | 1373.9082 | 1596.7041 | 3713.2653 | 3713.2653 |
| Enthalpy Btu/hr | 3.74057E+06 | 363312.8273 | 567759.2283 | 736469.7870 | 1.66754E+06 | 843613.5116 |
| Methane mole frac. | 0.7094 | 0.7094 | 0.7094 | 0.7094 | 0.7094 | 0.7094 |
| Ethane mole frac. | 0.1353 | 0.1353 | 0.1353 | 0.1353 | 0.1353 | 0.1353 |
| Propane mole frac. | 0.0794 | 0.0794 | 0.0794 | 0.0794 | 0.0794 | 0.0794 |
| i-Butane mole frac. | 0.0079 | 0.0079 | 0.0079 | 0.0079 | 0.0079 | 0.0079 |
| n-Butane mole frac. | 0.0193 | 0.0193 | 0.0193 | 0.0193 | 0.0193 | 0.0193 |
| i-Pentane mole frac. | 0.0036 | 0.0036 | 0.0036 | 0.0036 | 0.0036 | 0.0036 |
| n-Pentane mole frac. | 0.0037 | 0.0037 | 0.0037 | 0.0037 | 0.0037 | 0.0037 |
| n-Hexane mole frac. | 0.0019 | 0.0019 | 0.0019 | 0.0019 | 0.0019 | 0.0019 |
| n-Heptane mole frac. | 0.0015 | 0.0015 | 0.0015 | 0.0015 | 0.0015 | 0.0015 |
| Nitrogen mole frac. | 0.0377 | 0.0377 | 0.0377 | 0.0377 | 0.0377 | 0.0377 |
| $CO_2$ mole frac. | 0.0003 | 0.0003 | 0.0003 | 0.0003 | 0.0003 | 0.0003 |

| | Stream | | | | |
|---|---|---|---|---|---|
| | G | H | I | J | K |
| Vapour frac. | 1.0000 | 0.0000 | 0.2493 | 0.0000 | 1.0000 |
| Temperature F. | −50.0000 | −50.0000 | −75.0208 | −75.0208 | −75.0208 |
| Pressure psia | 808.0000 | 808.0000 | 465.0000 | 465.0000 | 465.0000 |
| Molar Flow 1 bmole/hr | 497.3333 | 381.1043 | 381.1043 | 286.1066 | 94.9977 |
| Mass Flow lb/hr | 9099.1097 | 10614.4396 | 10614.4396 | 8936.9844 | 1677.4552 |
| Liq Vol Flow barrel/day | 1866.0042 | 1827.2611 | 1827.2611 | 1468.7707 | 358.4903 |
| Enthalpy Btu/hr | 1.16308E+06 | −317738.6979 | −317738.6979 | −559024.1194 | 241285.5401 |
| Methane mole frac. | 0.8527 | 0.5224 | 0.5224 | 0.4002 | 0.8904 |
| Ethane mole frac. | 0.0713 | 0.2188 | 0.2188 | 0.2711 | 0.0613 |
| Propane mole frac. | 0.0164 | 0.1616 | 0.1616 | 0.2123 | 0.0091 |
| i-Butane mole frac. | 0.0008 | 0.0172 | 0.0172 | 0.0228 | 0.0003 |
| n-Butane mole frac. | 0.0014 | 0.0427 | 0.0427 | 0.0567 | 0.0005 |
| i-Pentane mole frac. | 0.0001 | 0.0081 | 0.0081 | 0.0108 | 0.0000 |

TABLE-continued

| | | | | | |
|---|---|---|---|---|---|
| n-Pentane mole frac. | 0.0001 | 0.0084 | 0.0084 | 0.0112 | 0.0000 |
| n-Hexane mole frac. | 0.0000 | 0.0044 | 0.0044 | 0.0058 | 0.0000 |
| n-Heptane mole frac. | 0.0000 | 0.0035 | 0.0035 | 0.0046 | 0.0000 |
| Nitrogen mole frac. | 0.0570 | 0.0125 | 0.0125 | 0.0041 | 0.0380 |
| $CO_2$ mole frac. | 0.0002 | 0.0004 | 0.0004 | 0.0004 | 0.0003 |

| | Stream | | | |
|---|---|---|---|---|
| | L | M | N | O |
| Vapour frac. | 0.0000 | 0.0000 | 0.3654 | 0.0831 |
| Temperature F. | −75.0208 | −75.0208 | −135.9755 | −84.5585 |
| Pressure psia | 465.0000 | 465.0000 | 60.0000 | 365.0000 |
| Molar Flow 1 bmole/hr | 185.3971 | 100.7095 | 185.3971 | 100.7095 |
| Mass Flow lb/hr | 5791.1661 | 3145.8186 | 5791.1661 | 3145.8186 |
| Liq Vol Flow barrel/day | 951.7634 | 517.0073 | 951.7634 | 517.0073 |
| Enthalpy Btu/hr | −362247.6288 | −196776.4906 | −362247.6288 | −196776.4906 |
| Methane mole frac. | 0.4002 | 0.4002 | 0.4002 | 0.4002 |
| Ethane mole frac. | 0.2711 | 0.2711 | 0.2711 | 0.2711 |
| Propane mole frac. | 0.2123 | 0.2123 | 0.2123 | 0.2123 |
| i-Butane mole frac. | 0.0228 | 0.0228 | 0.0228 | 0.0228 |
| n-Butane mole frac. | 0.0567 | 0.0567 | 0.0567 | 0.0567 |
| i-Pentane mole frac. | 0.0108 | 0.0108 | 0.0108 | 0.0108 |
| n-Pentane mole frac. | 0.0112 | 0.0112 | 0.0112 | 0.0112 |
| n-Hexane mole frac. | 0.0058 | 0.0058 | 0.0058 | 0.0058 |
| n-Heptane mole frac. | 0.0046 | 0.0046 | 0.0046 | 0.0046 |
| Nitrogen mole frac. | 0.0041 | 0.0041 | 0.0041 | 0.0041 |
| $CO_2$ mole frac. | 0.0004 | 0.0004 | 0.0004 | 0.0004 |

| | Stream | | | | | |
|---|---|---|---|---|---|---|
| | P | Q | R | S | T | U |
| Vapour frac. | 1.0000 | 0.0000 | 0.9998 | 0.0000 | 0.6569 | 0.5162 |
| Temperature F. | 2.7762 | 140.9996 | 1.5141 | 99.7231 | 100.0000 | −0.1563 |
| Pressure psia | 365.0000 | 365.0000 | 355.0000 | 250.0000 | 610.5000 | 52.5000 |
| Molar Flow 1 bmole/hr | 187.8653 | 98.2507 | 187.8653 | 98.2507 | 218.2711 | 37.0797 |
| Mass Flow lb/hr | 4267.3515 | 4669.7745 | 4267.3515 | 4669.7745 | 7088.1588 | 1562.6122 |
| Liq Vol Flow barrel/day | 846.1759 | 622.6344 | 846.1759 | 622.6344 | 1142.0116 | 221.1330 |
| Enthalpy Btu/hr | 652318.5364 | 172216.4273 | 653218.5364 | 35305.8626 | 715632.6452 | 33312.7907 |
| Methane mole frac. | 0.6032 | 0.0122 | 0.6032 | 0.0122 | 0.3626 | 0.1361 |
| Ethane mole frac. | 0.3143 | 0.1884 | 0.3143 | 0.1884 | 0.2703 | 0.2448 |
| Propane mole frac. | 0.0725 | 0.4797 | 0.0725 | 0.4797 | 0.2352 | 0.3476 |
| i-Butane mole frac. | 0.0014 | 0.0637 | 0.0014 | 0.0637 | 0.0270 | 0.0511 |
| n-Butane mole frac. | 0.0018 | 0.1617 | 0.0018 | 0.1617 | 0.0680 | 0.1385 |
| i-Pentane mole frac. | 0.0001 | 0.0314 | 0.0001 | 0.0314 | 0.0128 | 0.0300 |
| n-Pentane mole frac. | 0.0000 | 0.0325 | 0.0000 | 0.0325 | 0.0128 | 0.0311 |
| n-Hexane mole frac. | 0.0000 | 0.0169 | 0.0000 | 0.0169 | 0.0051 | 0.0135 |
| n-Heptane mole frac. | 0.0000 | 0.0134 | 0.0000 | 0.0134 | 0.0024 | 0.0066 |
| Nitrogen mole frac. | 0.0062 | 0.0000 | 0.0062 | 0.0000 | 0.0036 | 0.0007 |
| $CO_2$ mole frac. | 0.0006 | 0.0001 | 0.0006 | 0.0001 | 0.0004 | 0.0002 |

| | Stream | | | | |
|---|---|---|---|---|---|
| | V | W | X | Y | Z |
| Vapour frac. | 0.8314 | 0.0000 | 1.0000 | 1.0000 | 1.0000 |
| Temperature F. | 74.1910 | 101.7406 | 96.0000 | 96.0000 | 96.0000 |
| Pressure psia | 365.0000 | 365.0000 | 352.0000 | 805.0000 | 50.0000 |
| Molar Flow 1 bmole/hr | 181.2008 | 4.2056 | 282.8630 | 497.3333 | 222.4767 |
| Mass Flow lb/hr | 5525.6873 | 265.6195 | 5944.8067 | 9099.1097 | 7353.7781 |
| Liq Vol Flow barrel/day | 920.9181 | 30.8848 | 1204.6662 | 1886.0042 | 1172.8963 |
| Enthalpy Btu/hr | 682344.5251 | 229.7937 | 1.27930E+06 | 2.03506E+06 | 1.31124E+06 |
| Methane mole frac. | 0.4089 | 0.0245 | 0.6996 | 0.8527 | 0.3562 |
| Ethane mole frac. | 0.2755 | 0.0820 | 0.2294 | 0.0713 | 0.2667 |
| Propane mole frac. | 0.2122 | 0.2179 | 0.0512 | 0.0164 | 0.2348 |
| i-Butane mole frac. | 0.0220 | 0.0058 | 0.0010 | 0.0008 | 0.0275 |
| n-Butane mole frac. | 0.0536 | 0.1901 | 0.0013 | 0.0014 | 0.0703 |
| i-Pentane mole frac. | 0.0092 | 0.0795 | 0.0000 | 0.0001 | 0.0140 |
| n-Pentane mole frac. | 0.0091 | 0.1021 | 0.0000 | 0.0001 | 0.0145 |
| n-Hexane mole frac. | 0.0034 | 0.1109 | 0.0000 | 0.0000 | 0.0071 |
| n-Heptane mole frac. | 0.0015 | 0.1371 | 0.0000 | 0.0000 | 0.0049 |
| Nitrogen mole frac. | 0.0042 | 0.0001 | 0.0169 | 0.0570 | 0.0035 |
| $CO_2$ mole frac. | 0.0004 | 0.0001 | 0.0005 | 0.0002 | 0.0004 |

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A process for recovering a gas product stream and a liquid product stream from a hydrocarbon gas stream comprising:

(a) separating the hydrocarbon gas stream into a first liquid stream and an inlet vapor stream;

(b) cooling the inlet vapor stream in a heat exchange means to a preselected processing temperature of at least below about −50° F.;

(c) separating the cooled inlet vapor stream into a first non-condensible vapor stream and a second liquid stream;

(d) flashing the second liquid stream to form an outlet vapor stream and a refrigerating fluid stream;

(e) expanding at least a portion of the refrigerating fluid stream to reduce the pressure of the refrigerating fluid stream to less than about 25 psig and the temperature of the refrigerating fluid stream below about −70° F.;

(f) passing the portion of refrigerating fluid stream through the heat exchange means in heat exchange relationship to the inlet vapor stream;

(g) compressing and separating the refrigerating fluid stream to provide a compressed vapor stream, a fluid stream and a third liquid stream;

(h) expanding the third liquid stream of step (g) to produce a cooled third liquid stream;

(i) passing the cooled third liquid stream of step (h) to the heat exchange means in heat exchange relationship to the inlet vapor stream;

(j) stabilizing the first liquid stream of step (a) and the fluid stream of step (g) to produce a second non-condensible vapor stream and the liquid product stream; and (k) removing the first non-condensible vapor stream of step (c), the outlet vapor stream of step (d) and the second non-condensible vapor stream of step (j) as the gas product stream.

2. The process of claim 1 further comprising: passing another portion of the refrigerating fluid stream of step (d) to a stabilizer vessel for contact with the first liquid stream of step (a) and the liquid stream of step (g) to produce the second non-condensible vapor stream of step (j) and the liquid product stream.

3. The process of claim 2 further comprising:

compressing the outlet vapor stream of step (d) and the second non-condensible vapor stream of step (j) to a pressure substantially corresponding to the pressure of the non-condensible vapor stream of step (c).

4. The process of claim 3 further comprising:

dehydrating the inlet vapor stream prior to cooling same in the heat exchange means.

5. The process of claim 4 wherein the cooling of step (b) further comprises:

combining the portion of the expanded refrigeration fluid stream of step (c) and the cooled fluid stream of step (h) in the first heat exchanger of the second portion of the first heat exchange zone so that the combined expanded refrigeration fluid stream of step (c) and the cooled fluid stream of step (h) are in a heat exchange relationship with the first inlet vapor stream in the second portion of the first heat exchange zone and cooperates to define a partially closed refrigeration loop.

6. The process of claim 5 further comprising:

controlling the rate of compression of the refrigerating fluid stream in response to the temperature of the non-condensible vapor stream of step (j).

7. The process of claim 6 further comprising:

controlling the rate of the flow of the second liquid stream into a flash separator vessel for flashing of the second liquid stream in response to pressure of the second liquid stream.

8. The process of claim 3 wherein the heat exchange means is characterized as having a first heat exchange zone and a second heat exchange zone, and wherein the cooling of step (b) comprises:

passing the vapor inlet stream through a first portion of the first heat exchange zone;

separating the inlet vapor stream after passage through the first portion of the first heat exchange zone into a cooled first inlet vapor stream, a cooled second inlet vapor stream and a cooled third inlet vapor stream;

passing the cooled first, second and third inlet vapor streams through a first, second and third heat exchanger, respectively, in a second portion of the first heat exchange zone;

recombining the first, second and third cooled inlet vapor stream; and passing the recombined cooled inlet vapor stream through the second heat exchange zone to further cool the inlet vapor stream to the preselected processing temperature.

9. The process of claim 8 wherein the cooling of step (b) further comprises:

passing the outlet vapor stream of step (d) and the second non-condensible vapor stream of step (j) through the second heat exchanger of the second portion of the first heat exchange zone in a heat exchange relationship to the second inlet vapor stream;

passing the first non-condensible vapor stream of step (c) through the third heat exchanger of the second portion of the first heat exchange zone in a heat exchange relationship to the third inlet vapor stream; and passing the outlet vapor stream of step (d) and the second non-condensible vapor stream of step (j) through one channel of a heat exchanger of the first heat exchange zone and the first non-condensible vapor stream of step (c) through a second channel of the heat exchanger of the first heat exchange zone.

10. A method for recovering a gas product stream and a liquid product stream from a hydrocarbon gas stream comprising:

separating the hydrocarbon gas stream into a first liquid stream and an inlet vapor stream;

cooling the inlet vapor stream in a first heat exchanger means to remove heat therefrom and to provide a cooled inlet vapor stream;

cooling the cooled inlet vapor stream in a second heat exchanger means to lower the temperature of the cooled inlet vapor stream to a preselected processing temperature of at least about −50° F.;

separating the cooled inlet vapor stream into a first non-condensible vapor stream and a second liquid stream;

passing the first non-condensible vapor stream through the first heat exchanger means in a heat exchange relationship with a first portion of the inlet vapor stream;

means for recovering the first non-condensible vapor stream as a first portion of the gas product stream;

separating the second liquid stream into an outlet vapor stream and a refrigerating fluid stream;

passing the outlet vapor stream through the first heat exchanger means in a heat exchange relationship with a second portion of the inlet vapor stream;

introducing the first liquid hydrocarbon stream and a portion of the refrigerating fluid stream into a stabilizer vessel and recovery therefrom a second non-condensible vapor stream and the liquid product stream;

controlling the temperature of the second non-condensible vapor stream at a preselected process temperature in an upper portion of the stabilizer vessel;

passing the second non-condensible vapor stream through the heat exchanger means wherein the second non-condensible vapor stream is combined with the outlet vapor stream in a heat exchange relationship with the second portion of the inlet vapor stream;

recovering the second non-condensible vapor stream and the outlet vapor stream as a second portion of the gas product stream;

passing the refrigerant stream through an expansion valve to reduce the pressure of the refrigerant stream to about 25 psig or less so as to effectively lower the temperature of the refrigerant stream to at least about −70° F.;

passing another portion of the refrigerating fluid stream sequentially through the second heat exchanger means and the first heat exchanger means in a heat exchange relationship with the cooled effluent vapor stream and a third portion of the inlet vapor stream, respectively;

compressing the portion of the refrigerating fluid stream after passage through the first and second heat exchanger means to form a compressed refrigerating fluid stream;

separating the compressed refrigerating fluid stream to provide a compressed vapor stream having an elevated temperature;

passing the compressed vapor stream to a reboiler to provide heat for stabilizing and reboiling of the first liquid stream in the stabilizer vessel;

recompressing the compressed vapor stream so as to form a compressed fluid stream and a compressed third liquid stream;

passing the third liquid stream through an expansion valve to provide a cooled third liquid stream;

passing the cooled third liquid stream through the second heat exchanger means to define a partially closed refrigeration loop;

passing the compressed fluid stream through an expansion valve to reduce the pressure thereof to a pressure substantially corresponding to the pressure of the stabilizer vessel and into the stabilizer vessel.

11. The method of claim 10 further comprising:

compressing the outlet vapor stream and the second non-condensible vapor stream to a pressure substantially corresponding to the pressure of the gas product stream.

12. The method of claim 11 further comprising:

dehydrating the inlet vapor stream so as to provide the inlet vapor stream with low water dew points.

13. The method of claim 12 further comprising:

controlling the rate of recompression of the compressed vapor stream in response to the temperature of the second non-condensible vapor stream.

14. The method of claim 13 further comprising:

controlling the rate of flow of the second liquid stream in response to the pressure of the second liquid stream.

15. A system for recovering a gas product stream and a liquid product stream from a hydrocarbon gas stream comprising:

first separation means for separating the hydrocarbon gas stream into a first liquid stream and an inlet vapor stream;

first heat exchanger means in fluid communication with the first separation means for cooling the inlet vapor stream;

second heat exchanger means in fluid communication with the first heat exchanger means for cooling the cooled inlet vapor stream to a temperature of about −50° F. or less;

second separation means in fluid communication with the second heat exchanger means for separating the cooled inlet vapor stream into a first noncondensible vapor stream and a second liquid stream;

first conduit means for passing the first non-condensible vapor stream through the first heat exchanger means so that the first non-condensible vapor stream is in a heat exchange relationship with a first portion of the inlet vapor stream;

second conduit means for recovering the first non-condensible vapor stream as a first portion of the gas product stream;

third separation means in fluid communication with the second separation means for separating the second liquid stream into an outlet vapor stream and a refrigerating fluid stream;

third conduit means for passing the outlet vapor stream from the third separation means through the first heat exchanger means so that the outlet vapor stream is in a heat exchange relationship with a second portion of the inlet vapor stream;

stabilizer means in fluid communication with the first and third separation means for receiving the first liquid stream and a portion of the refrigerating fluid stream so as to produce a second non-condensible vapor stream and the liquid product stream;

means for controlling the temperature of the second non-condensible vapor stream at a preselected process temperature in an upper portion of the stabilizer means;

fourth conduit means for passing the second non-condensible vapor stream through the first heat exchanger means so that the second non-condensible vapor stream is in a heat exchange relationship with a third portion of the inlet vapor stream wherein the stabilizer vapor is comingled with the vapor stream;

means for recovering the second non-condensible vapor stream as a second portion of the gas product stream;

fifth conduit means for passing the remaining portion of the refrigerating fluid stream sequentially through the second heat exchanger mean and the first heat exchanger means and the refrigerating fluid stream;

means for reducing the pressure of the refrigerating fluid stream prior to passage through the second heat exchanger means to a pressure of about 25 psig or less so as to effectively lower the temperature of the refrigerating fluid stream to at least about −70° F.;

first compressor means operably connected to and in fluid communication with the first heat exchanger means for compressing the refrigerating stream to provide a heated vapor stream and for separating the refrigerating fluid stream into a compressed vapor stream, a fluid stream and a third liquid stream;

reboiler means fluidly connected to the compressor means for defining a flow path for a heated vapor stream so that the heated vapor stream can be circulated between the compressor means and the reboiler means so as to provide heat for the reboiler means;

means for reducing the pressure of the third liquid stream so as to substantially reduce the temperature of the third liquid stream;

sixth conduit means for passing the cooled third liquid stream through the first heat exchanger means wherein the cooled third liquid stream is contacted with the refrigerating fluid stream in the first heat exchanger means in a heat exchange relationship with the first portion of the inlet vapor stream: and seventh conduit means for passing the fluid stream to the stabilizer means wherein the first liquid stream, the portion of the refrigerating fluid stream introduced into the stabilizer means and the fluid stream are stabilized.

16. The system of claim 15 further comprising:

second compressor means for compressing the outlet vapor stream and the second non-condensible vapor stream to a pressure substantially corresponding to the pressure of the first non-condensible vapor stream.

17. The system of claim 16 further comprising: dehydration means for dehydrating the inlet vapor stream.

18. The system of claim 17 further comprising:

first control means for controlling the speed and throughput of the first compressor means in response to the temperature in the second separation means.

19. The system of claim 18 wherein the first control means is operably connected to the third separation means so as to control the flow of the refrigerating fluid from the third separation means through the second heat exchanger means.

20. The system of claim 19 further comprising:

second control means operably connected to the third separation means for controlling the flow of the second liquid stream into the third separation means and the flow of the cooled vapor inlet stream into the second separation means in response to pressure in the third separation means.

* * * * *

UNITED STATES PATENT AND TRADEMARK OFFICE

CERTIFICATE OF CORRECTION

PATENT NO. : 5,309,720

DATED : May 10, 1994

INVENTOR(S) : Lory L. Johnson and Donald V. Nicol

It is certified that error appears in the above-indentified patent and that said Letters Patent is hereby corrected as shown below:

Column 10, line 32, after "10" insert --)--;

Column 13, line 34, after "comprising:" delete "passing";

Column 13, line 35, before "another" indent and insert --passing--; and

Column 16, line 60, delete "mean" and substitute therefor --means--.

Signed and Sealed this

Eighteenth Day of October, 1994

*Attest:*

*Attesting Officer*

Bruce Lehman

BRUCE LEHMAN

*Commissioner of Patents and Trademarks*